US005926989A

United States Patent [19]

Oliver, Sr.

[11] Patent Number: 5,926,989

[45] Date of Patent: Jul. 27, 1999

[54] TRIGGER FINGER STOP ASSEMBLY

[76] Inventor: Frank Oliver, Sr., 117 Kathleen La., Lillington, N.C. 27546

[21] Appl. No.: 08/951,245

[22] Filed: Oct. 16, 1997

[51] Int. Cl.[6] ..... F41A 17/22

[52] U.S. Cl. ..... 42/70.11; 42/70.07

[58] Field of Search ..... 42/70.11, 70.07

[56] References Cited

U.S. PATENT DOCUMENTS

| | | | |
|---|---|---|---|
| D. 188,328 | 7/1960 | Christiansen . | |
| D. 196,842 | 11/1963 | Schaefer . | |
| D. 259,433 | 6/1981 | Pharr, Jr. . | |
| D. 300,343 | 3/1989 | Gannon . | |
| 1,686,482 | 10/1928 | Windle | 42/70.07 |
| 2,080,202 | 5/1937 | Drake | 42/70.07 |
| 2,590,516 | 3/1952 | Breymann | 42/70.07 |
| 2,875,127 | 12/1959 | Finnegan . | |
| 3,020,663 | 2/1962 | Newson . | |
| 3,064,383 | 11/1962 | Newson, Sr. . | |
| 3,066,433 | 12/1962 | Rogers et al. | 42/70.11 |
| 3,956,842 | 5/1976 | Ballenger . | |
| 3,964,200 | 6/1976 | Patterson | 42/70.07 |
| 4,395,837 | 8/1983 | Durnal | 42/70.11 |
| 4,916,842 | 4/1990 | Hardy . | |
| 5,012,605 | 5/1991 | Nishioka | 42/70.11 |
| 5,024,017 | 6/1991 | Nishioka . | |
| 5,033,218 | 7/1991 | Nelson . | |
| 5,075,994 | 12/1991 | Nishioka . | |

FOREIGN PATENT DOCUMENTS

| | | | |
|---|---|---|---|
| 00006761 | 3/1910 | United Kingdom | 42/70.07 |

*Primary Examiner*—Charles T. Jordan
*Assistant Examiner*—Denise J. Buckley
*Attorney, Agent, or Firm*—Litman, Kraai & Brown LLC

[57] ABSTRACT

A trigger finger stop assembly for a firearm including a stock and a trigger depending downwardly therefrom includes a plate for limiting penetration of a trigger finger to position the first digit thereof on the trigger. The stop assembly includes mounting means for mounting the plate on one side of the trigger guard in proximity to and laterally offset from the trigger.

10 Claims, 4 Drawing Sheets

TRIGGER FINGER STOP ASSEMBLY

BACKGROUND OF THE INVENTION

1. Field of the Invention

The present invention relates generally to firearm accessories, and in particular to a stop assembly for limiting penetration by the trigger finger in a firearm trigger guard and for assisting with the proper positioning of the index finger on the trigger.

2. Description of the Prior Art

Firearm technology has progressed to a level that permits highly accurate shooting under a variety of conditions. Modern firearms, ammunition and sighting devices all contribute to the accuracy and effectiveness currently achievable by trained shooters.

In virtually every application of firearms, including sport, military, competition and law enforcement, considerable emphasis is placed on training shooters for greater accuracy. Substantial resources of time and ammunition are consumed by training and practice in the various fields which employ firearms for defense, competition and hunting. Firearm training normally has several kinesiologic aspects, including proper stance, proper grip and controlled breathing.

An important part of shooting accuracy relates to the technique used for actually pulling the trigger and discharging the weapon. For example, it is well known that the trigger of a firearm should be squeezed and not pulled to avoid jerking the firearm muzzle and thus deflecting the shot. Squeezing the trigger, as opposed to pulling, can significantly improve accuracy.

The natural inclination of many shooters is to extend the trigger finger well into the trigger guard opening. Although the trigger can be pulled with the second digit in this manner, it is generally preferable to use the first digit.

Heretofore there has not been available a trigger finger stop assembly for a firearm which combines the advantages and features of the present invention.

SUMMARY OF THE INVENTION

In the practice of the present invention, a trigger finger stop assembly is provided which includes a base mounted on the firearm. A plate depends downwardly from the base at a closed side of the trigger guard. The base can be mounted on the firearm stock by suitable means such as screws, or it can be snapped in place on mounting posts extending downwardly from the stock. In yet another modified embodiment, the plate is retained in place on one side of the trigger guard by suitable snap-on mounting brackets adapted to capture the existing trigger guard.

OBJECTS AND ADVANTAGES OF THE INVENTION

The principle objects and advantages of the present invention include: providing a trigger finger stop assembly for a firearm; providing such a stop assembly which improves accuracy; providing such a stop assembly which facilitates training; providing such a stop assembly which automatically encourages the self-teaching of proper trigger squeezing techniques; providing such a stop assembly which is adaptable to a wide variety of firearms, including rifles, pistols, shotguns, etc.; providing such a stop assembly which tends to promote firearm safety; providing such a stop assembly which can improve marksmanship; providing such a stop assembly which can enhance firearm safety; and providing such a stop assembly which is economical to manufacture, efficient in operation and capable of a long operating life.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
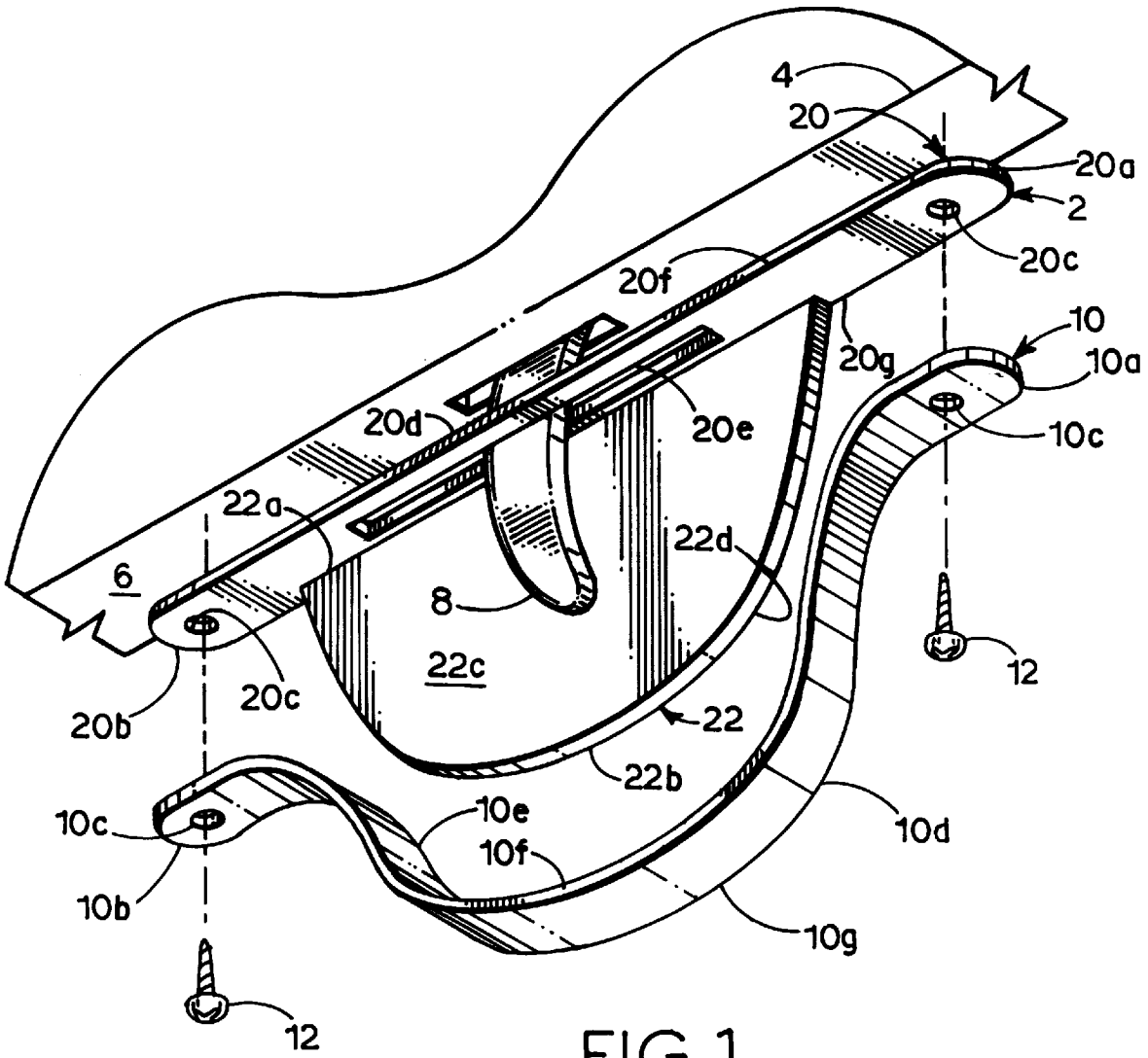
FIG. 1 is a lower, front, right side perspective view of a trigger finger stop assembly embodying the present invention, shown in position for mounting on a firearm.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a trigger finger stop assembly embodying the present invention. The stop assembly 2 is adapted for mounting on a firearm 4 including a stock 6 and a trigger 8 depending downwardly therefrom. A trigger guard 10 includes front and back ends 10*a,b* each having a mounting screw receiver 10*c*. A trigger guard body 10*d* is suspended from the trigger guard ends 10*a,b* and partially encircles the trigger 8 forming a trigger guard opening 10*e* which receives the trigger 8. The trigger guard 10 includes open and closed sides 10*f,g*. The trigger guard 10 is secured in place on the stock 6 by a pair of mounting screws 12 each extending through a respective trigger guard end screw receiver 10*c*.

II. Trigger Finder Stop Assembly 2

The trigger finger stop assembly 2 generally includes a base 20 and a plate 22. The base 20 includes front and back ends 20*a,b* each including a mounting screw receiver 20*c*. A base medial section 20*d* extends longitudinally between the front and back ends 20*a,b* and includes a longitudinally-extending trigger slot 20*e* which receives the trigger 8. The base 20 includes first and second sides 20*f,g*.

The plate 22 includes an upper edge 22*a* fixedly connected to the base medial section 20*d* adjacent a respective side 20*f* or 20*g* (the trigger finger stop assembly 2 is reversible) of the base 20. A lower edge 22*b* is somewhat arcuate in configuration to conform generally to the shape of the trigger guard opening 10*e*. The plate 22 includes an inner face 22*c* adjacent to the trigger 8 and an outer face 22*d*. The plate inner side 22*c* is accessible through the trigger guard opening 10*e*.

In operation, the stop assembly 2 functions to properly position the finger of a person firing the firearm 4 whereby his or her trigger finger can only partially extend into the trigger guard opening 10*e*. More specifically, the trigger 8 is engaged by the first digit of the trigger finger, i.e., distally of the first knuckle. The trigger 8 is squeezed in the normal manner, with the stop assembly plate 22 maintaining the shooter's finger in proper position with its outer or distal digit in engagement with the trigger 8.

III. First Modified Embodiment Trigger Finger Stop Assembly 102

Figure 2:
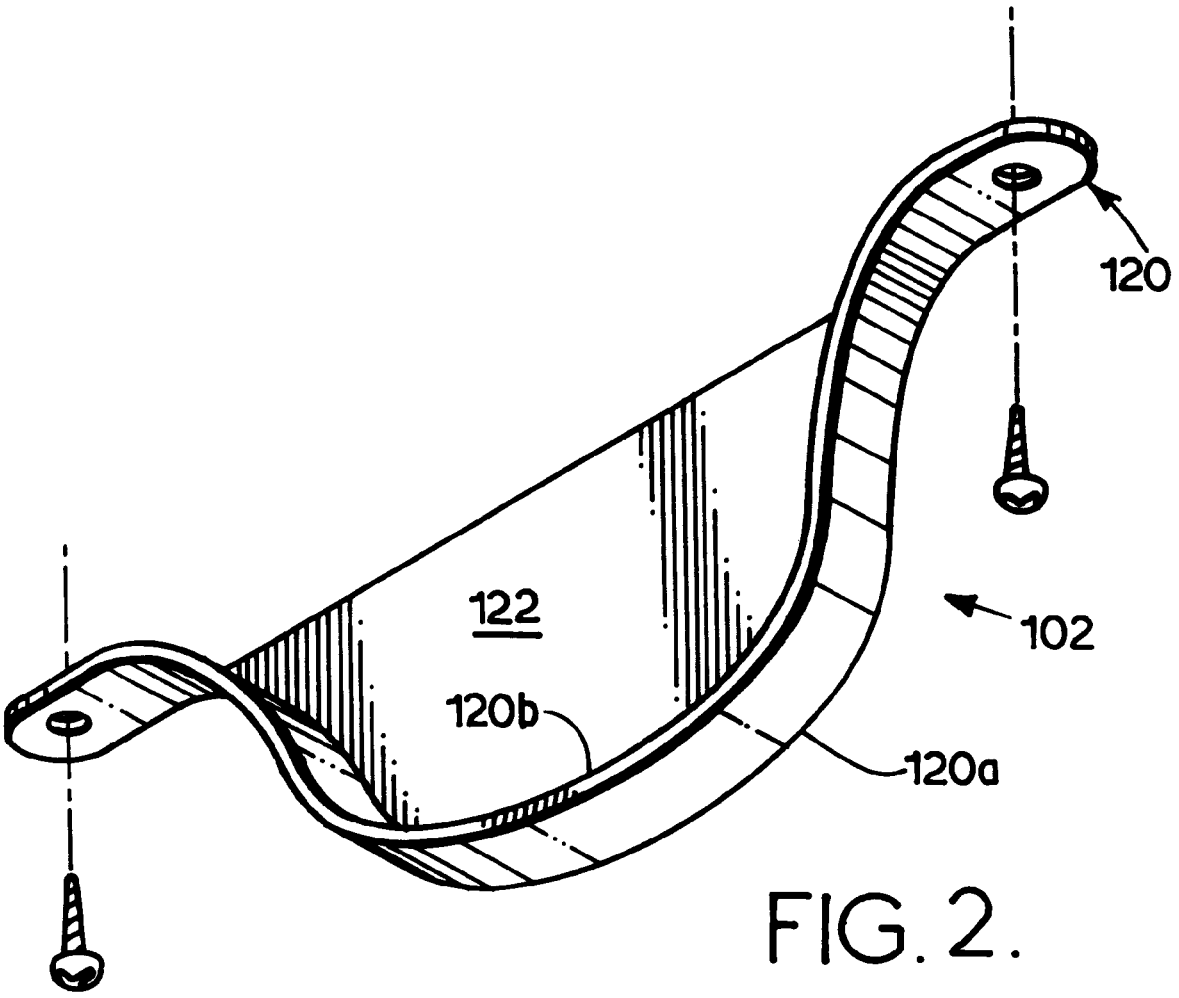
FIG. 2 is a lower, front, right side perspective view of a trigger finger stop assembly comprising a first modified embodiment of the present invention.
Figure 3:
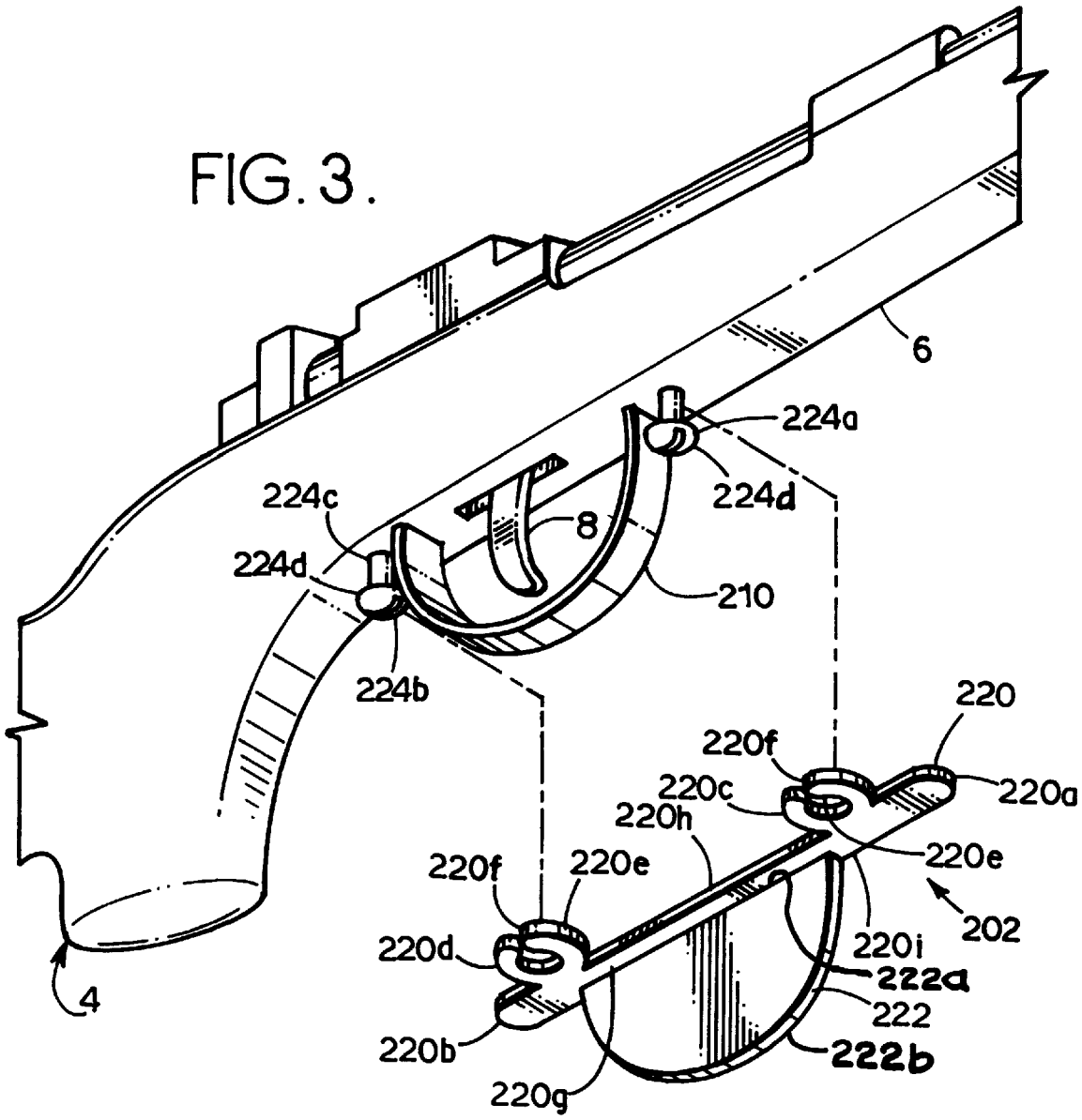
FIG. 3 is a lower, front, right side perspective view of a trigger finger stop assembly comprising a second modified embodiment of the present invention.

A trigger finger stop assembly 102 comprising a first modified embodiment of the present invention is shown in FIG. 2 and generally includes an integral trigger guard 120 and a plate 122. The trigger guard 120 of the stop assembly 102 is generally similar in configuration to the trigger guard 10 described above, with a plate 122 generally covering a respective trigger guard closed side 120*a*. The trigger 8 is accessible through a trigger guard open side 120*b*. The first modified stop assembly 102 operates in a manner similar to the stop assembly 2 described above to facilitate proper technique and improved marksmanship with the firearm 4 on which it is mounted.

IV. Second Modified Embodiment Trigger Finger Stop Assembly 202

The reference numeral 202 generally designates a trigger finger stop assembly comprising a second modified embodiment of the present invention. The stop assembly 202 generally includes a base 220 and a plate 222. The base 220 includes front and back ends 220*a,b*. Front and back snap rings 220*c,d* are located adjacent to the base front and back ends 220*a,b* respectively and each includes a snap ring receiver 220*e* accessible through a snap ring slot 220*f*. The base 220 includes a longitudinally-extending medial section 220*g* with inner and outer edges 220*h,i* respectively.

The plate 222 includes an upper edge 222*a* fixedly connected to the medial section 220*g* adjacent to its outer edge 220*i*. A lower edge 222*b* of the plate 222 extends downwardly from the upper edge 222*a* in a generally arc-shaped configuration generally corresponding to the configuration of the trigger guard opening 10*e*. The plate 222 thus substantially covers the closed side of a trigger guard 210.

Front and back mounting posts 224*a,b* are mounted on the stock 6 and each includes a shaft 224*c* mounting a head 224*d* for retaining the stop assembly 202 in place thereon. The stop assembly 202 operates in a manner similar to the stop assemblies 2 and 102, and can easily be installed on or removed from the firearm 4 by means of the snap connection between the snap rings 220*c,d* and the mounting posts 224*a,b*.

V. Third Modified Embodiment Trigger Finger Stop Assembly 302

Figure 4:
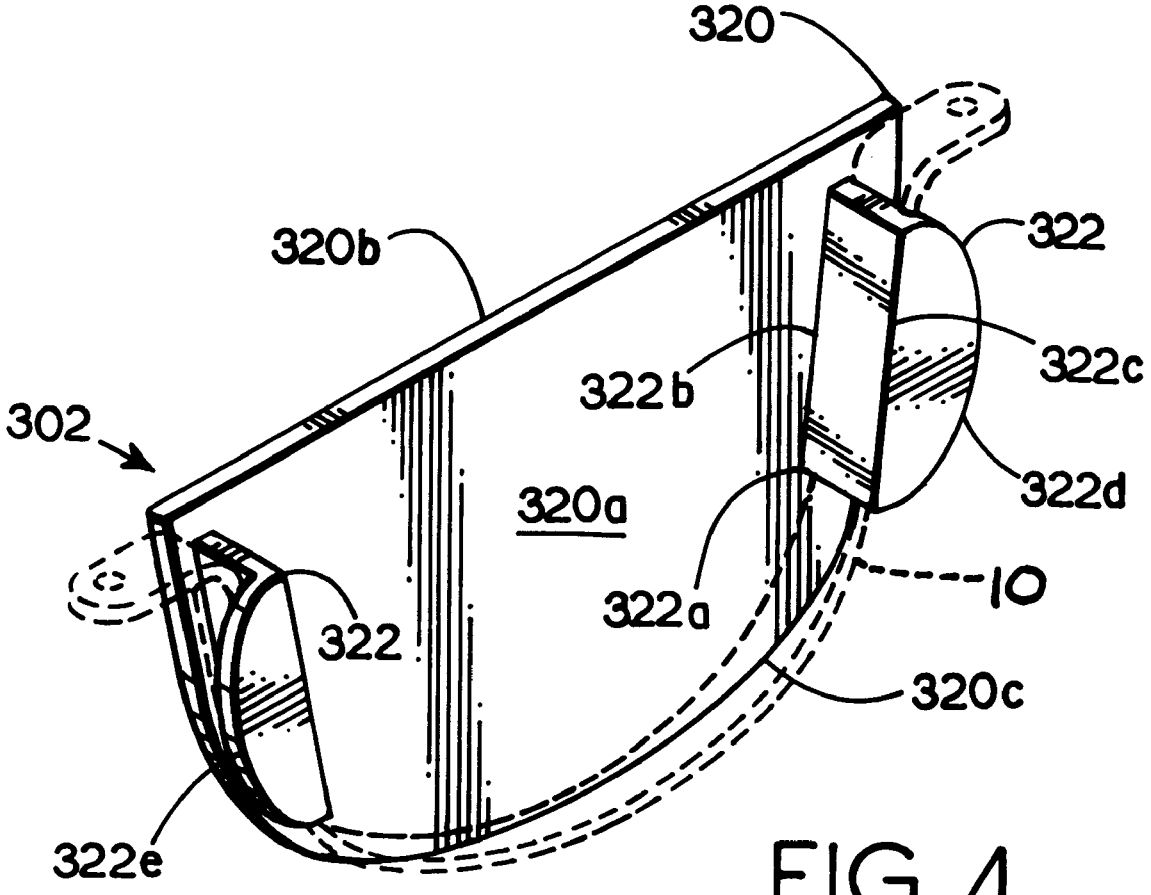
FIG. 4 is an upper, rear, right side perspective view of a trigger finger stop assembly comprising a third modified embodiment of the present invention.

A trigger finger stop assembly comprising a third modified embodiment of the present invention for use with the above-described trigger guard 10 is generally designated by the reference numeral 302 and is shown in FIG. 4. The third modified stop assembly 302 generally includes a plate 320 mounting a pair of mounting brackets 322.

The plate 320 includes an inner face 320*a* which engages the closed side log of the trigger guard 10 and a plate upper edge 320*b*. The plate 320 also includes a generally arcuate lower edge 320*c* depending from the upper edge 320*c* and having a configuration generally corresponding to the configuration of the trigger guard 10.

Each mounting bracket 322 includes an extension 322*a* with a proximate end 322*b* mounted on the plate side 320*a* and a distal end 322*c*. Front and back lugs 322*d,e* are mounted on and project forwardly and rearwardly respectively from the extension distal ends 322*c*.

In operation, the third modified embodiment trigger finger stop assembly 302 is relatively easy to install on and remove from the trigger guard 10. The stop assembly 302 can be installed by squeezing the mounting brackets 322 towards each other to facilitate passing the lugs 322*d,e* through the trigger guard 10. The stop assembly 302 is then permitted to spring outwardly whereby the lugs 322*d,e* extend to engage an open side 10*f* of the trigger guard 10. The third modified embodiment trigger finger stop assembly 302 can be reversible for mounting on either side of the trigger guard 10 whereby either a right-handed or left-handed shooter can be accommodated.

It is to be understood that while certain forms of the present invention have been illustrated and described herein, it is not to be limited to the specific forms or arrangement of parts described and shown.

What is claimed and desired to be secured by Letters Patent is as follows:

1. A trigger finger stop assembly for a firearm including a stock and a trigger protruding from the stock, which includes:

(a) a plate positioned adjacent to and laterally offset from the trigger;

(b) plate mounting means connected to the plate and adapted for mounting on the firearm;

(c) said plate mounting means including a base mounted on the firearm stock in proximity to the trigger;

(d) front and back stop assembly mounting posts depending downwardly from said stock in front of and behind said trigger respectively; and (e) said base including front and back mounting post receivers each open laterally at and including a respective mounting post receiver slot.

2. The stop assembly according to claim 1, which includes:

(a) said base being generally horizontal and including a longitudinally-extending base slot; and (b) said trigger protruding through said base slot.

3. The stop assembly according to claim 1, which includes:

(a) said base including front and back ends each having a screw receiver; and (b) a pair of mounting screws each extending through a respective screw receiver and into said stock.

4. The stop assembly according to claim 3, which includes:

(a) a trigger guard having front and back end tabs each having a respective trigger guard receiver receiving a respective mounting screw and a body depending downwardly therefrom and suspended between said trigger guard end tabs generally around said trigger, said trigger guard forming a finger opening with said trigger positioned therein.

5. The stop assembly according to claim 1 wherein said stop assembly is reversible with said plate thereof being positionable on either side of said trigger.

6. The stop assembly according to claim 1, which includes:

(a) said base having front and back snap rings each including a respective mounting post receiver; and (b) said base having a medial section extending between said snap rings and including an inner edge positioned adjacent to the trigger.

7. A trigger finger stop assembly for a firearm including a stock, a trigger protruding from the stock and a trigger guard with front and back ends each having a screw receiver, a body depending downwardly from said front and back ends in a downwardly-concave configuration, a trigger guard opening and trigger guard open and closed sides, which stop assembly includes:

(a) a base having:

(1) a front end;

(2) a back end;

(3) each said base end having a receiver aligned with a respective trigger guard receiver;

(4) a medial section extending between said base front and back ends;

(5) said medial section having a longitudinally-extending trigger slot receiving said trigger; and (6) first and second sides;

(b) a plate having:

(1) an upper edge connected to said base adjacent to and laterally offset from said trigger slot;

(2) a lower edge depending downwardly from said upper edge in a downwardly-concave configuration; and (3) an inner face positioned adjacent to said trigger.

8. A trigger finger stop assembly for a firearm including a stock, a trigger depending downwardly from the stock and a trigger guard with an opening receiving said trigger, said trigger guard having open and closed sides, which includes:

(a) a plate with an inner face, said inner face being adapted to be positioned against said trigger guard closed side adjacent to and laterally offset from said trigger; and (b) front and back mounting brackets each including:

(1) an extension extending laterally from said plate inner face and adapted for placement within said trigger guard opening adjacent to said trigger guard; and (2) a lug projecting from said extension and adapted for engaging said open side of said trigger guard.

9. A trigger finger stop assembly for a firearm including a stock and a trigger protruding from the stock, which includes:

(a) a plate positioned adjacent to and laterally offset from the trigger;

(b) plate mounting means connected to the plate and adapted for mounting on the firearm;

(c) said plate mounting means including a base mounted on the firearm stock in proximity to the trigger; and (d) a trigger guard integrally formed with said base and said plate, said trigger guard being suspended from said base and having an opening receiving said trigger.

10. A trigger finger stop assembly for a firearm including a stock and a trigger protruding from the stock, which includes:

(a) a plate positioned adjacent to and laterally offset from the trigger;

(b) plate mounting means connected to the plate and adapted for mounting on the firearm;

(c) said plate mounting means including front and back mounting brackets each including:

(1) an extension with an extension proximate end connected to said plate and an extension distal end; and (d) a lug connected to said extension distal end and projecting therefrom in spaced relation from said plate.

* * * * *